US010246300B2

(12) United States Patent
Polak et al.

(10) Patent No.: US 10,246,300 B2
(45) Date of Patent: Apr. 2, 2019

(54) ELEVATOR VIRTUAL AERODYNAMIC SHROUD

(71) Applicant: Otis Elevator Company, Farmington, CT (US)

(72) Inventors: David R. Polak, Glastonbury, CT (US); Ray-Sing Lin, Glastonbury, CT (US); David E. Parekh, Farmington, CT (US); Mark S. Thompson, Tolland, CT (US)

(73) Assignee: Otis Elevator Company, Farmington, CT (US)

( * ) Notice: Subject to any disclaimer, the term of this patent is extended or adjusted under 35 U.S.C. 154(b) by 231 days.

(21) Appl. No.: 15/185,571

(22) Filed: Jun. 17, 2016

(65) Prior Publication Data

US 2017/0001838 A1 Jan. 5, 2017

Related U.S. Application Data

(60) Provisional application No. 62/186,702, filed on Jun. 30, 2015.

(51) Int. Cl.

| | |
|---|---|
| ***B66B 11/02*** | (2006.01) |
| ***B66B 13/30*** | (2006.01) |
| ***B66B 19/00*** | (2006.01) |

(52) U.S. Cl.

CPC ..... *B66B 11/0226* (2013.01); *B66B 11/0206* (2013.01); *B66B 13/30* (2013.01); *B66B 19/007* (2013.01)

(58) Field of Classification Search

CPC . B66B 11/0226; B66B 11/0206; B66B 13/30; B66B 19/007

See application file for complete search history.

(56) References Cited

U.S. PATENT DOCUMENTS 1,767,988 A * 6/1930 Knapp ..... F24F 7/007 126/41 C
2,350,389 A * 6/1944 Coulton ..... B66B 11/024 454/68

(Continued)

FOREIGN PATENT DOCUMENTS

CA 2280363 A1 2/2000
CN 203033608 U 7/2013

(Continued)

OTHER PUBLICATIONS

European Search Report dated Nov. 17, 2016 for EP Patent Application No. 16177315.5.

(Continued)

*Primary Examiner* — Michael A Riegelman

(74) *Attorney, Agent, or Firm* — Bachman & LaPointe, P.C.

(57) ABSTRACT

An elevator car (20) comprises: a cab (24) having a top, a bottom, a left side, a right side, a front, and a back, the front having a door (50); and a frame (22) supporting the cab. The cab comprises a perimeter shroud (120; 320; 420; 620) protruding above a surface of the top and leaving a well (130) exposing a central portion of an upper surface (60) of the top; the perimeter shroud protrudes above the upper surface; and the perimeter shroud has, in vertical section, a curved portion.

20 Claims, 12 Drawing Sheets

(56) References Cited

U.S. PATENT DOCUMENTS

| | | | | | |
|---|---|---|---|---|---|
| 2,532,268 | A * | 11/1950 | Christmann | B66B 11/024 | 187/414 |
| 3,945,468 | A * | 3/1976 | Miura | B66B 11/0226 | 187/401 |
| 4,699,251 | A * | 10/1987 | Orndorff | B66B 11/0226 | 187/401 |
| 5,018,602 | A * | 5/1991 | Salmon | B66B 11/026 | 187/401 |
| 5,080,003 | A * | 1/1992 | Kappeler | B66B 11/024 | 187/401 |
| 5,117,946 | A | 6/1992 | Traktovenko et al. | | |
| 5,220,979 | A * | 6/1993 | Matsuda | B66B 11/0226 | 187/401 |
| 5,251,726 | A * | 10/1993 | de Jong | B66B 13/285 | 187/401 |
| 5,306,208 | A * | 4/1994 | Sommerrock | B66B 11/024 | 454/254 |
| 5,354,233 | A * | 10/1994 | Mandy | B66B 11/024 | 187/393 |
| 6,047,792 | A * | 4/2000 | Jin | B66B 11/0206 | 187/401 |
| 6,318,509 | B1 * | 11/2001 | Spieler | B66B 11/0226 | 187/401 |
| 7,665,583 | B2 * | 2/2010 | Kuipers | B66B 11/0005 | 187/404 |
| 9,457,993 | B2 * | 10/2016 | Somma | B66B 11/0206 | |
| 9,604,822 | B2 * | 3/2017 | Roivainen | H05K 999/99 | |
| 9,725,283 | B2 * | 8/2017 | Roivainen | B66B 9/00 | |
| 2006/0289242 | A1 * | 12/2006 | Oberer | B66B 11/0226 | 187/333 |
| 2009/0266648 | A1 | 10/2009 | Asensio Bazterra et al. | | |
| 2010/0012437 | A1 | 1/2010 | Smith | | |
| 2010/0116597 | A1 * | 5/2010 | Matsuda | B66B 11/0226 | 187/401 |
| 2010/0126810 | A1 * | 5/2010 | Opoku | B66B 11/024 | 187/401 |
| 2012/0318616 | A1 | 12/2012 | Carparelli et al. | | |
| 2013/0037354 | A1 | 2/2013 | Bloch et al. | | |
| 2013/0098713 | A1 * | 4/2013 | Urben | B66B 11/0226 | 187/401 |

FOREIGN PATENT DOCUMENTS

| | | | |
|---|---|---|---|
| JP | 5297536 | A | 8/1977 |
| JP | 05338966 | A | 12/1993 |
| JP | 0672670 | A | 3/1994 |
| JP | 0881161 | A | 3/1996 |
| JP | 2898815 | B | 6/1999 |
| WO | 2006071212 | A1 | 7/2006 |
| WO | 2012024929 | A1 | 3/2012 |

OTHER PUBLICATIONS

Kiyoshi Funai et al., The Development of Active Vibration Dampers for Super High-Speed Elevators, Lift Report, Sep. 2, 2004, VFZ Verlag für Zielgruppeninformationen GmbH & Co. KG, Dortmund, Germany, retrieved Nov. 2, 2014, http://www.lift-report.de/index.php/news/124/446/The-Development-of-Active-Vibration-Dampers-for-Super-High-Speed-Elevators.

Senior Design Project Program 2011-2012, 2012 UConn Mechanical Engineering Senior Design Book, 2012, p. 29, University of Connecticut, Storrs, Connecticut, retrieved Nov. 2, 2014, http://issuu.com/uconnme/docs/2012_senior_design_brochure_v10.

* cited by examiner

ELEVATOR VIRTUAL AERODYNAMIC SHROUD

CROSS-REFERENCE TO RELATED APPLICATION

Benefit is claimed of U.S. Patent Application No. 62/186,702, filed Jun. 30, 2015, and entitled "Elevator Virtual Aerodynamic Shroud", the disclosure of which is incorporated by reference herein in its entirety as if set forth at length.

BACKGROUND

The disclosure relates to elevators. More particularly, the disclosure relates to elevator aerodynamics.

Elevator aerodynamics raises issues of passenger comfort (e.g., limiting vibration and sound associated with turbulence).

Various shrouds or deflectors have been proposed to improve elevator aerodynamics. Because elevators are bi-directional, these shrouds may be mounted to the top and/or bottom of the elevator cab/car. Several proposed versions have long tapering bullet nose cross sections. U.S. Pat. No. 5,018,602, issued May 28, 1991, discloses air deflectors atop an elevator cab/car.

International Application No. PCT/CN2011/072572, published Mar. 1, 2012 as Pub. No. WO/2012/024929, discloses a relatively blunt shroud whose cross section is characterized by a flat top and quarter-round corners transitioning to the adjacent sides and back of the cab, leaving the flat extending to even with the cab front.

International Application No. PCT/US2004/043330, published Jul. 6, 2006 as Pub. No. WO/2006/071212, discloses a vertical perimeter fairing formed by angled walls extending upwards from the side and rear of the car top, leaving the front open and having an open upper end.

SUMMARY

One aspect of the disclosure involves an elevator car comprising: a cab having a top, a bottom, a left side, a right side, a front, and a back, the front having a door; and a frame supporting the cab. The cab comprises a perimeter shroud protruding above a surface of the top and leaving a well exposing a central portion of an upper surface of the top; the perimeter shroud protrudes above the upper surface; and the perimeter shroud has, in vertical section, a curved portion.

In one or more embodiments of any of the foregoing embodiments, the perimeter shroud extends at least 250° around the perimeter of the top.

In one or more embodiments of any of the foregoing embodiments, the perimeter shroud extends fully around the perimeter of the top.

In one or more embodiments of any of the foregoing embodiments, the perimeter shroud leaves a door exposed.

In one or more embodiments of any of the foregoing embodiments, the perimeter shroud covers a fan.

In one or more embodiments of any of the foregoing embodiments, the fan is a pair of fans.

In one or more embodiments of any of the foregoing embodiments, the fan is positioned to drive an air flow through ports in the perimeter shroud.

In one or more embodiments of any of the foregoing embodiments, the perimeter shroud encloses a fuse or circuit breaker box.

In one or more embodiments of any of the foregoing embodiments, the perimeter shroud encloses electrical equipment.

In one or more embodiments of any of the foregoing embodiments, the frame comprises: a crosshead, a pair of stiles, and a bolster.

In one or more embodiments of any of the foregoing embodiments, the crosshead is spaced above the perimeter shroud by a gap of at least 0.5 m.

In one or more embodiments of any of the foregoing embodiments, the perimeter shroud has a depth of 0.2 m to 0.5 m.

In one or more embodiments of any of the foregoing embodiments, the perimeter shroud protrudes above the upper surface by 0.1 m to 0.4 m and the curved portion has a radius of curvature of 0.05 m to 0.60 m over an arc of at least 45°.

In one or more embodiments of any of the foregoing embodiments, the curved portion has a radius of curvature of 0.10 to 0.40 m over an arc of at least 45°.

In one or more embodiments of any of the foregoing embodiments, the curved portion has a radius of curvature of 0.15 to 0.30 m over an arc of at least 80°.

In one or more embodiments of any of the foregoing embodiments, the curved portion has a said radius of curvature over a continuous said arc.

In one or more embodiments of any of the foregoing embodiments, the elevator comprises: a toe guard depending from the elevator along at least one side; and a bottom perimeter shroud along at least two sides.

In one or more embodiments of any of the foregoing embodiments, the perimeter shroud, in section, is continuously curving over said arc.

In one or more embodiments of any of the foregoing embodiments, said arc extends to within 0.05 m of an apex of the perimeter shroud.

In one or more embodiments of any of the foregoing embodiments, said arc is formed along an extruded plastic member or along a bent sheet.

In one or more embodiments of any of the foregoing embodiments, the curved portion is effective to provide at least one of a noise reduction or a drag reduction.

In one or more embodiments of any of the foregoing embodiments, a method for retrofitting an elevator car to form the elevator comprises installing the perimeter shroud.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
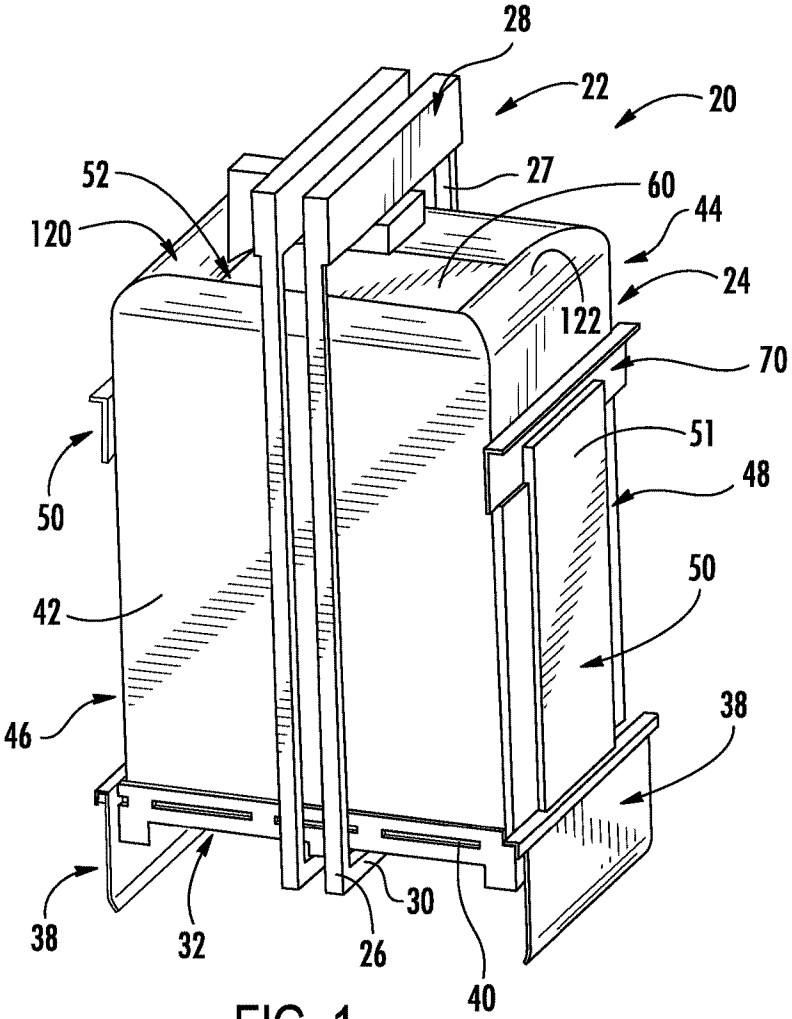
FIG. 1 is a view of an elevator car/cab showing a first modification in the form of a perimeter shroud.

FIG. 1 shows an elevator car 20 comprising a frame 22 supporting a cab 24. The frame comprises a pair of vertical stiles 26, 27, an upper crosshead beam (crosshead) 28, and a lower bolster or plank 30 arranged in a rectangle. The bolster 30 may support a platform 32 which, in turn, supports or forms the cab floor. The crosshead bears conventional features for mounting to the traction equipment (e.g., ropes, cables, or belt). Toe guards 38 may depend from the platform below any cab door(s). Additional bracing and other structural features are routine and are not discussed. The exemplary frame (and each of its four main members) has two sections (a forward section and a rear section spaced apart from each other and secured by bracing (not shown).

The cab comprises a floor 40, side walls 42, 44, a rear wall 46 (which may either be a closed wall or, in this example, may be open and receive a door unit 50), an open front 48 receiving a door unit 50 (having one or more doors 51), and a top 52. A vertical direction goes from the floor or cab bottom to the top. The top has an upper surface 60. The crosshead 28 is typically spaced by a gap of about 0.5 meter or more above a central portion of the upper surface 60. Various other components may also protrude above the surface. These may include the door opener 70 (although not protruding in the illustrated example), electrical boxes, fan housings, work lights, wiring, and other small components not shown in this de-featured view.

Figure 2:
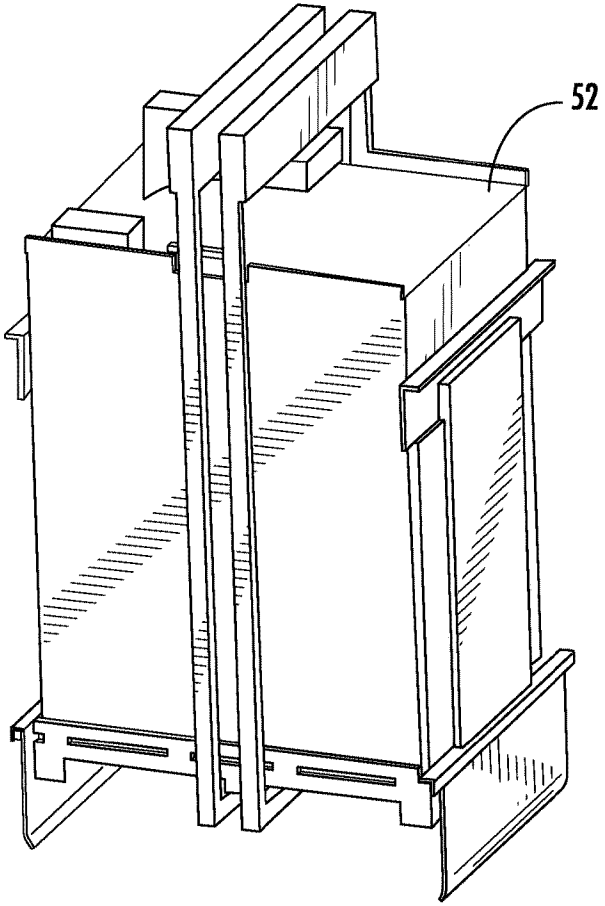
FIG. 2 (PRIOR ART)
FIG. 2 is a view of a prior art unshrouded elevator car.

FIG. 2 shows a baseline shroudless cab. The flat top, its sharp edges, and any protruding components all can contribute to aerodynamic debits.

Figure 4:
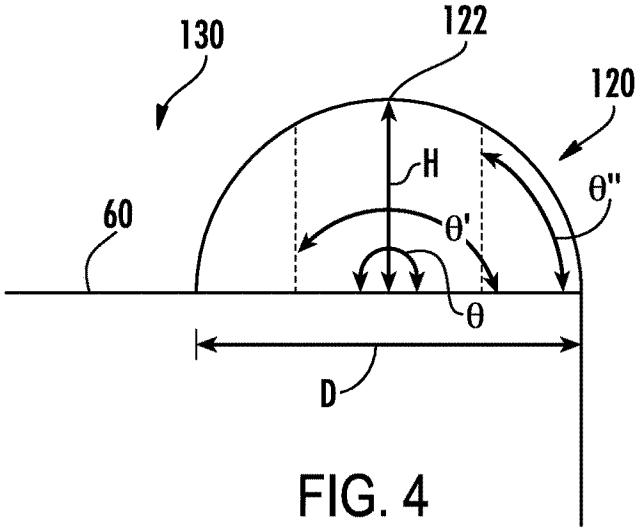
FIG. 4 is a vertical sectional view of the cab, taken along line 4-4 of FIG. 3.
Figure 11:
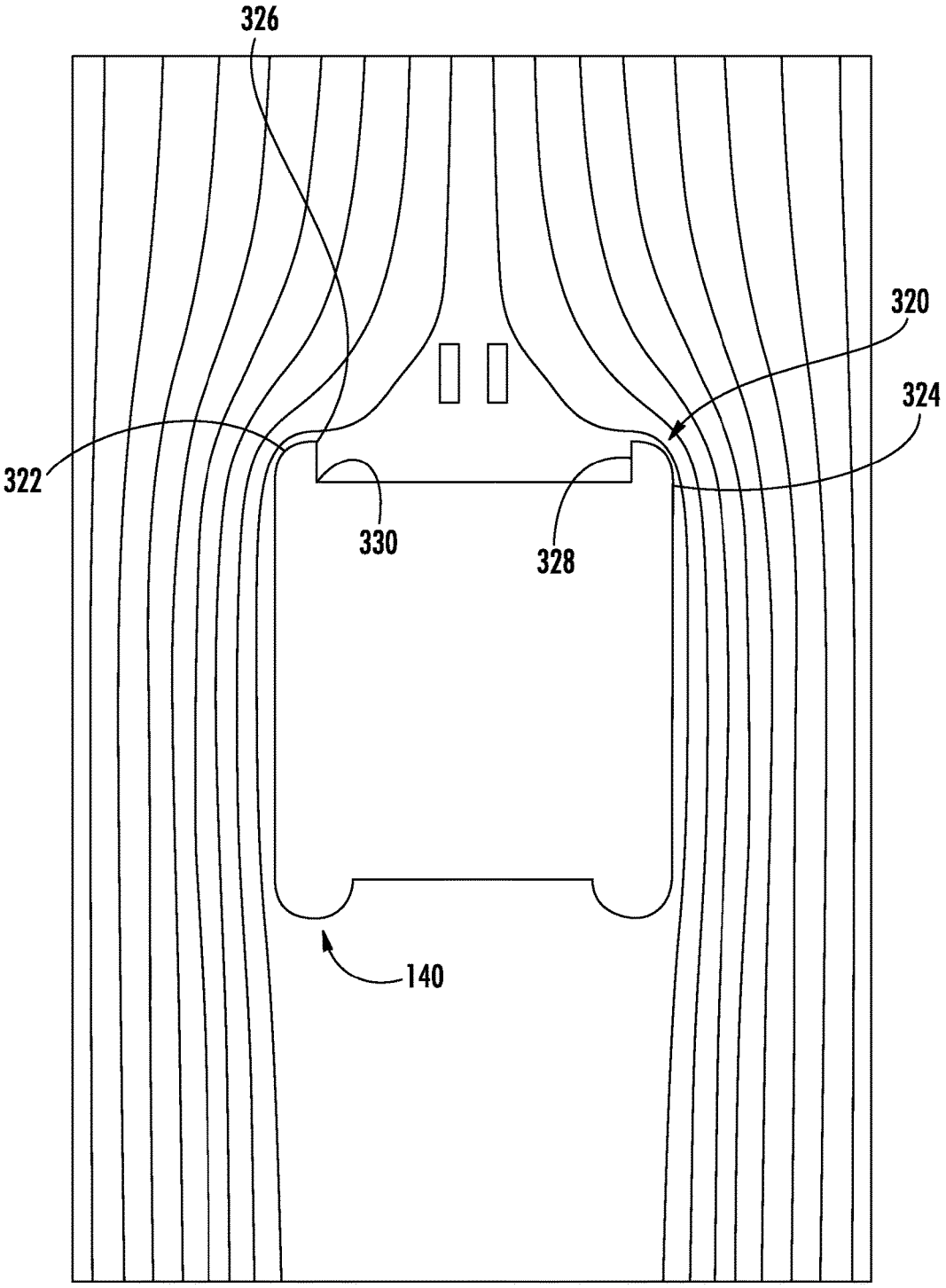
FIG. 11 is a schematic sectional view of a fourth modified car.

Means may be provided for improving basic cab aerodynamics and optionally reducing the aerodynamic debits of the protruding components. Instead of the tall angled sharp-edged structure of PCT/US2004/043330, a perimeter aerodynamic structure (perimeter shroud) 120 (FIG. 1) has an arcuate surface cross-section. The exemplary cross-section is convex upward/outward with a convex arc spanning an apex 122 of the cross-section. The exemplary arc may span an exemplary angle (θ FIG. 4) of at least 45°, or at least 50°, or at least 60°, or at least 70°, or at least 80° or at least 90°, or at least 100°. Exemplary upper limits associated with any of those lower limits include 130°, or 150°, or 180°. FIG. 11 cuts off (e.g., at a wall 328) at an angle of about 90°; FIG. 4 shows alternative cutoffs/walls 328' and 328" with respective angles θ' (between 90° and 180°) and θ" (below 90°). Radius of curvature need not be constant (e.g., semi-elliptical features described below). Although continuously curving structures are shown, others may interrupt the curvature (e.g., with two or more separate segments combining to form the aforementioned θ.

Figure 3:
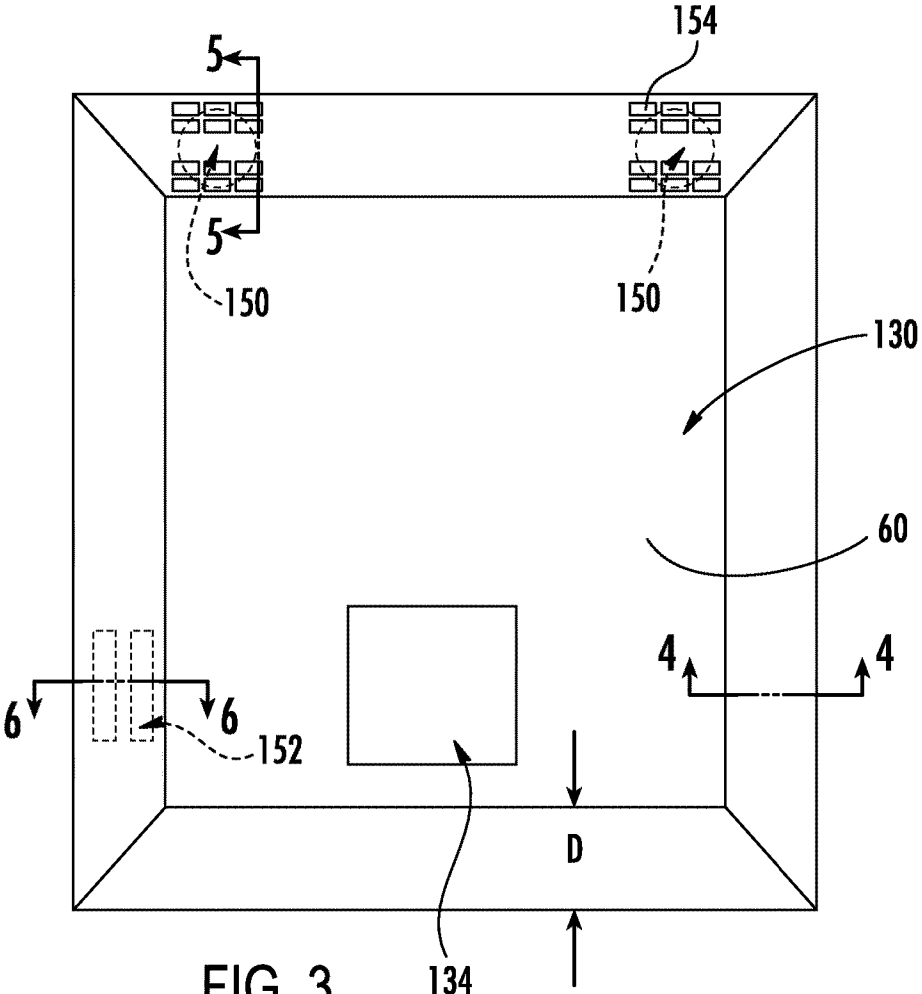
FIG. 3 is a top view of a cab of the modified car.

The exemplary structure has legs along all four edges of the top (FIG. 3) providing 100% or 360° encircling. Smaller extents may still be effective including at least 150°, at least 180°, at least 250°, at least 270°, at least 300° or at least 330°. Exemplary corresponding percentages of perimeter coverage are 42%, 50%, 69%, 75%, 83%, and 92%. The features may be essentially flush with the adjacent sides of the cab. Particular materials or manufacturing techniques may make them slightly proud (e.g., by up to 1 cm or 2 cm) or slightly subflush (e.g., recessed by up to 1 cm or 2 cm or 5 cm). An inboard portion of the structure defines a well 130 leaving a central portion of the top surface 60 exposed/open. This exposed portion may include the access panel 134 to the cab and may include electrical boxes, fan housings, wiring, and other components which may require access for periodic maintenance. Unlike a full shroud, the exposed portion enables such maintenance to be performed easily and safely.

A similar structure may be located along the bottom of the cab or platform. For example, it may be along the two or three sides not having toe guards 38. Clearly, on the bottom, an open area may not be required for standing. However, an open area may save on materials associated with forming a full bottom shroud (as 940 in FIG. 9 discussed below).

Figure 5:
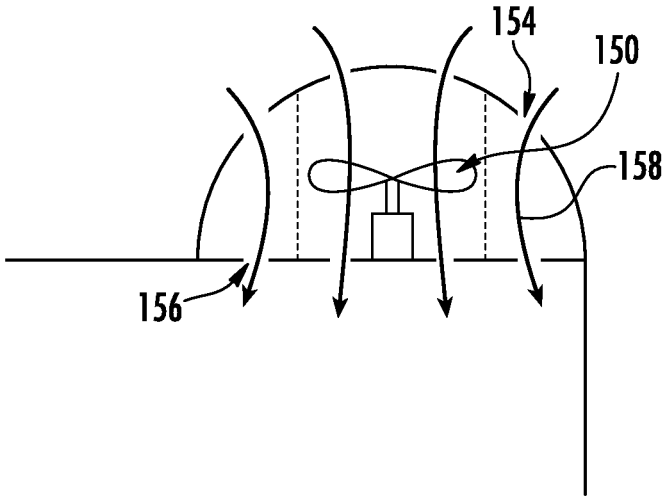
FIG. 5 is a vertical sectional view of the cab, taken along line 5-5 of FIG. 3.

Other components may be concealed within/under the structure 120 aside the well 130. Exemplary components include fans 150, electrical boxes 152 (e.g., fuse or circuit breaker boxes, communications equipment, power supplies, and/or control equipment), and the like. An exemplary fan 150 is an electric fan. The fan 150 may drive an airflow 158 (FIG. 5) along a flowpath passing through ports 154 on the feature 120 and 156 between the feature and the cab/car interior. The fan may be an intake fan as illustrated in FIG. 5 or an outlet/exhaust fan with opposite flow (e.g., one fan as an inlet fan and another fan as an exhaust fan).

The exemplary structure is of semi-circular cross-section so that a height H (FIG. 4) is the circle radius and a depth D is twice the circle radius. An exemplary radius is 0.05 m to 0.4 m, more particularly, 0.1 m to 0.3 m, or 0.14 m to 0.25 m. With an exemplary cab exterior width of 1.8 m and depth of 1.5 m, such a 0.2 m radius leaves an open area 1.4 m wide by 1.1 m deep (57% of the cab footprint). With an exemplary cab exterior width of 1.9 m and depth of 2.7 m, such a 0.2 m radius leaves an open area 1.5 m wide by 2.3 m deep (67% of the cab footprint). More broadly, the open area may account for 40% to 85% or 50% to 80% of the cab top. In general, exemplary depth and height may be at least 0.5 m or at least 0.1 m or at least 0.2 m. If upper limits are paired with any of said lower limits, they may include 0.6 m or 0.5 m or 0.4 m or 0.3 m.

Figure 7:
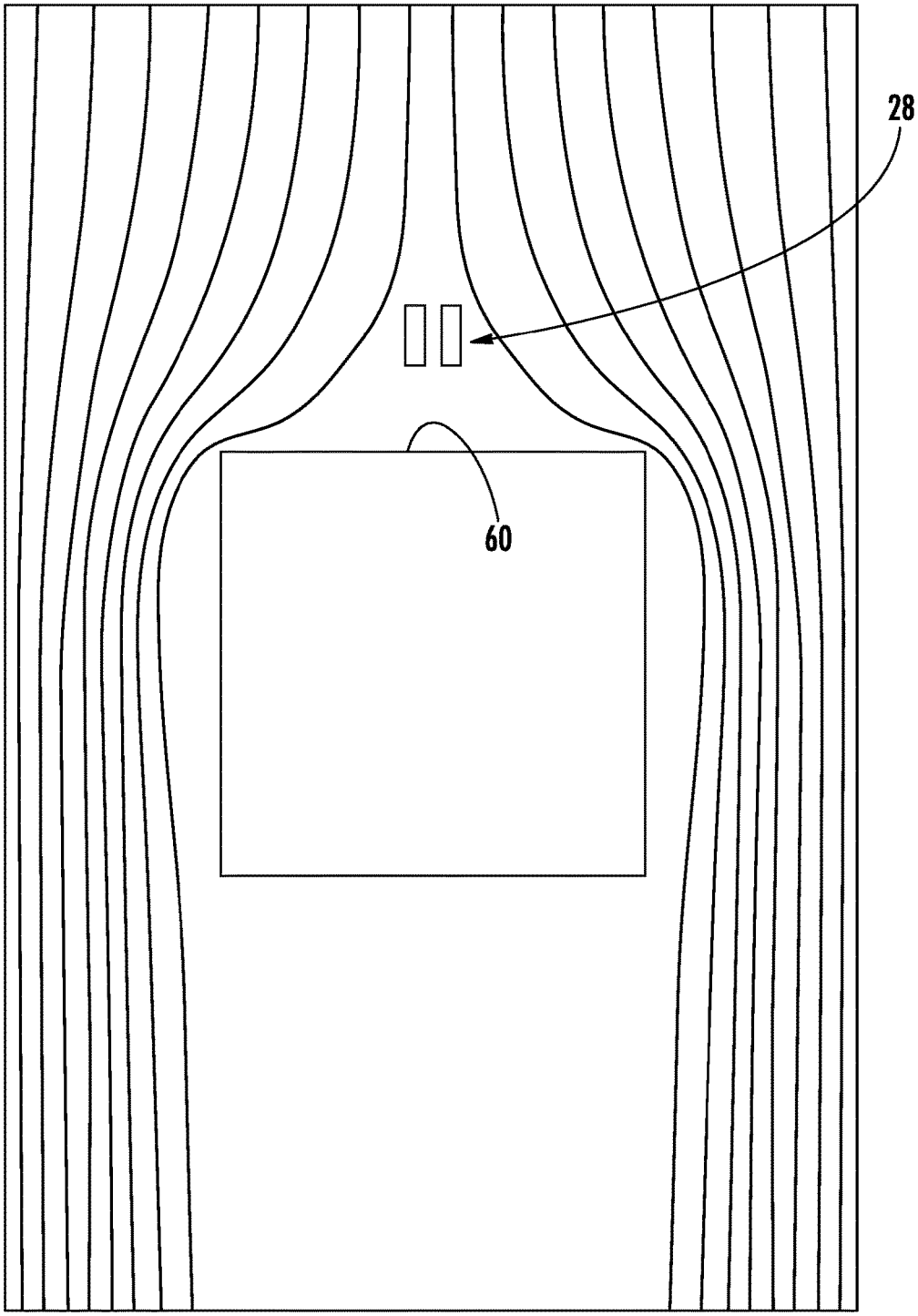
FIG. 7 is a streamline velocity field for a baseline car.
Figure 8:
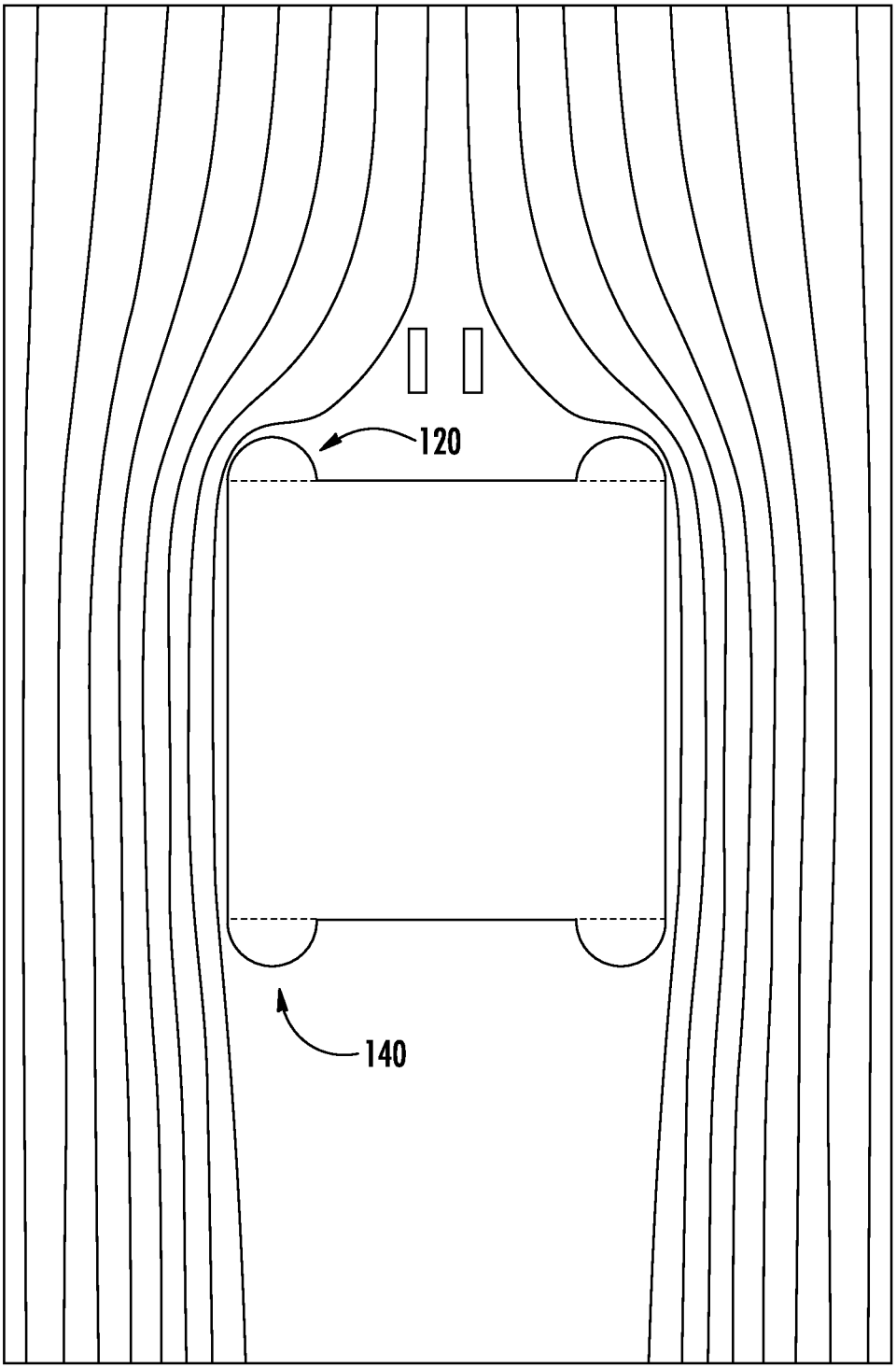
FIG. 8 is a streamline velocity field for a modified car.

FIG. 7 is a streamline velocity field for a baseline cab. FIG. 8 shows such a field for a cab having the features 120 top and 140 bottom. For the baseline cab, the flow separates at the top edges, leading to increased turbulent fluctuations in the flow. These fluctuations cause increased noise and vibration, reducing passenger ride quality and comfort. With the features 120, 140, the separated flow regions along the sides of the cab are eliminated, significantly reducing the turbulent fluctuations. The features are effective because of the Coanda effect, when a fluid jet is attracted to a nearby surface. When the surface does not allow the surrounding fluid to be entrained by the jet, the jet moves toward the surface. In the case of the elevator cab with features 120, 140, this eliminates the separated flow.

Figure 9:
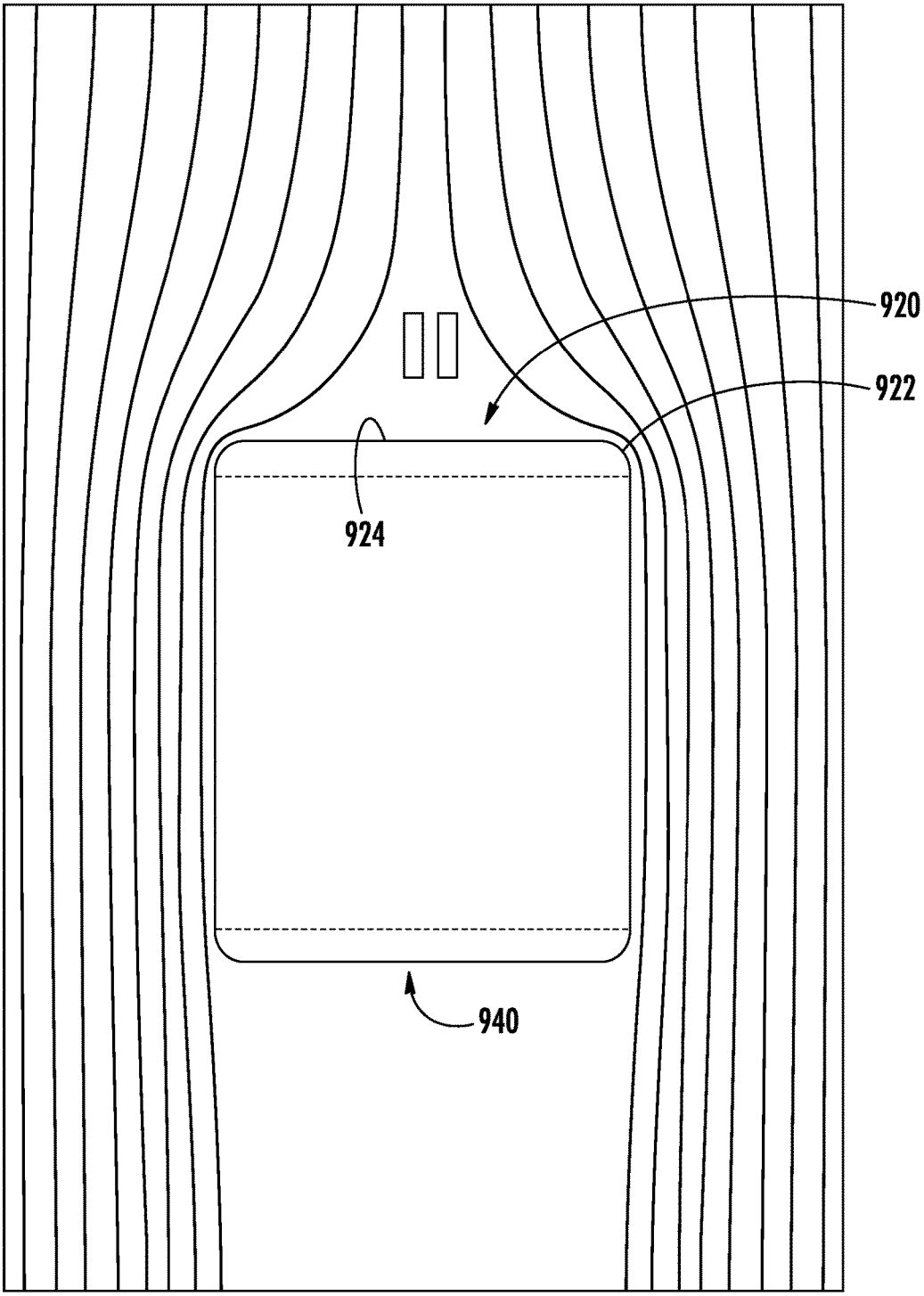
FIG. 9 is a streamline velocity field for a second modified car.
Figure 10:
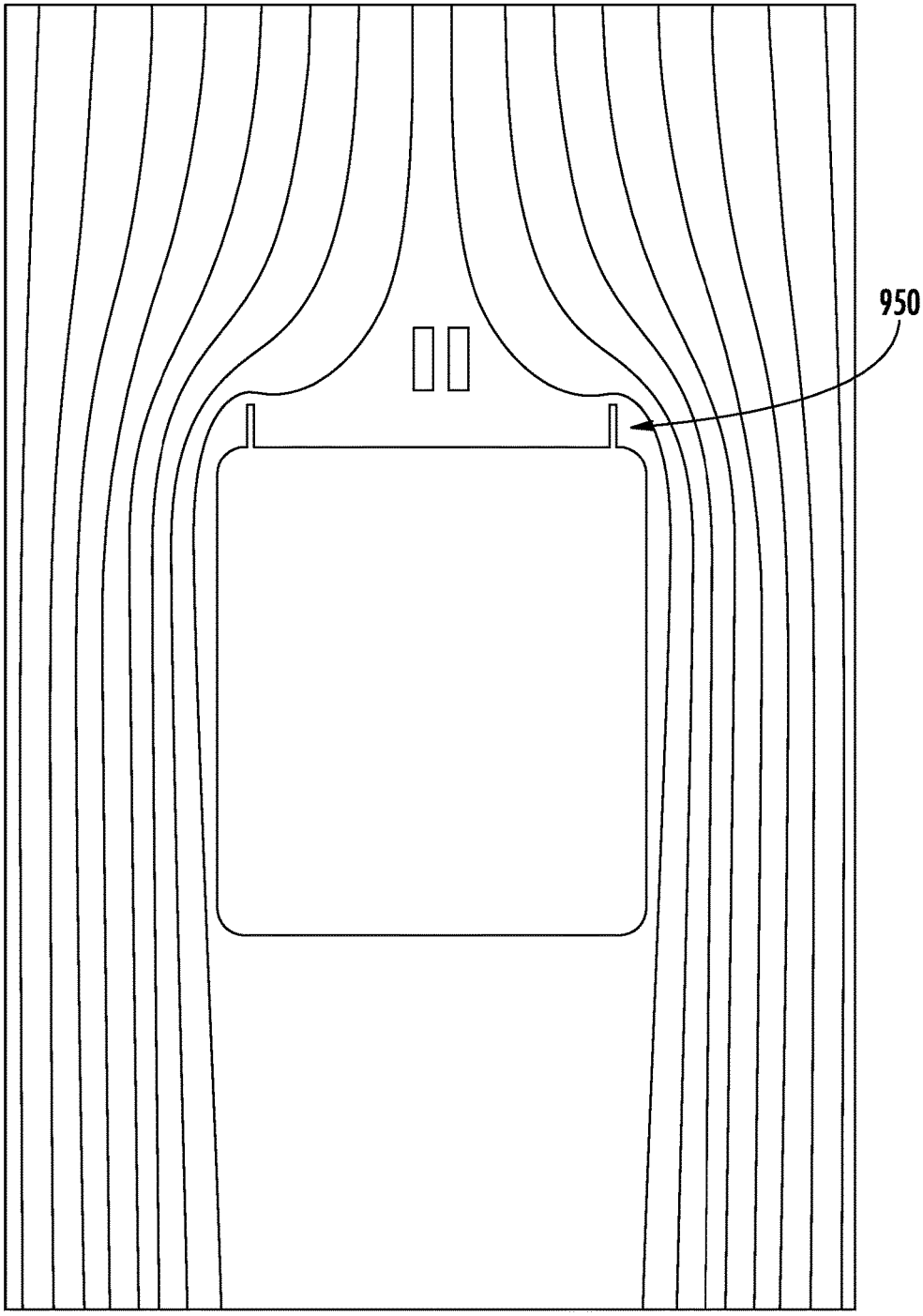
FIG. 10 is a streamline velocity field for a third modified car.

FIG. 9 is a streamline velocity field for a third modified car having a fully enclosed top shroud 920 and a fully enclosed bottom shroud 940. The shrouds each have a quarter-round perimeter surface 922 with a flat central surface 924. In one comparative drag simulation, the modification offered a 66% reduction in drag vs. an unshrouded baseline. However, the presence of the flat surface imposes additional problems. First, if the flat surface is to support loads, additional robust supporting structure must intervene between the car roof and the surface. Second, it may be desirable to add a short perimeter kick wall or plate 950 (FIG. 10) extending upward to contain tools, etc., and prevent them or a worker's feet from falling between the car and the hoistway walls. In another simulation, adding a short vertical kick wall 950 around the perimeter of the flat surface produced only a 48% drag reduction vs the unshrouded baseline. In contrast, a similar shroud with full half-round features 120, 140 does not need a separate perimeter kick plate and suffers only a slight debit at 65% drag reduction.

In a similar simulation of cars having only the top shroud features of 920 and 120, respective drag reductions during upward travel of 57% and 55% were predicted.

Figure 6:
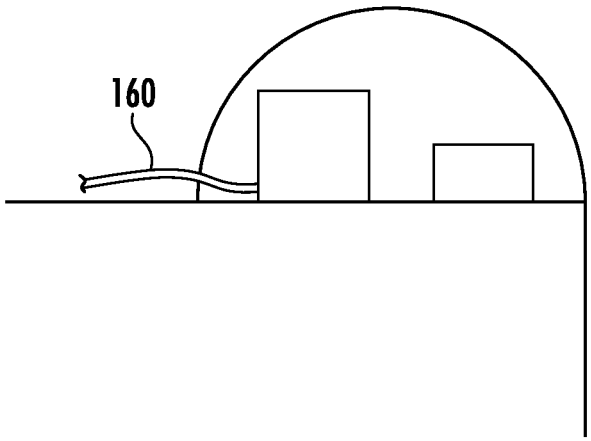
FIG. 6 is a vertical sectional view of the cab, taken along line 6-6 of FIG. 3.
Figure 15:
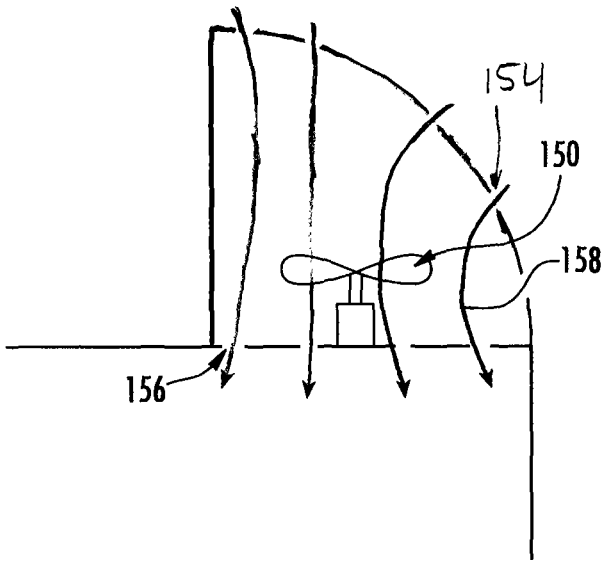
FIG. 15 is a vertical sectional view of the cab of the fourth modified car corresponding to FIG. 5.
Figure 16:
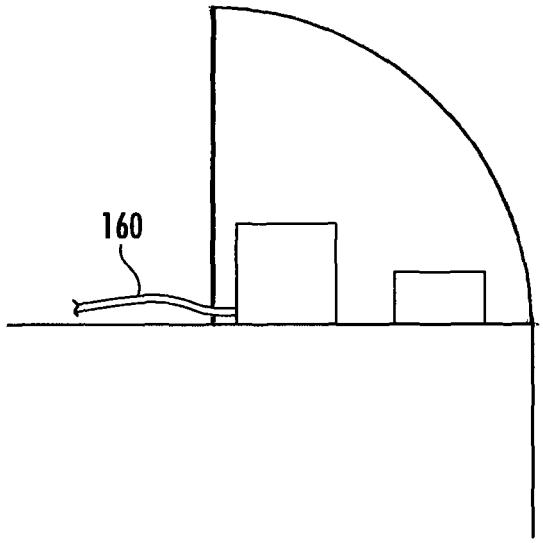
FIG. 16 is a vertical sectional view of the cab of the fourth modified car corresponding to FIG. 6.

FIG. 11 is a schematic sectional view of a modified car having quarter-round features 320 top and half round features 140 bottom. The quarter round features have an outer convex surface 322 extending from a lower end 324 at the car side to an apex 326. A vertical wall 328 extends between the apex and a lower end 330 at a perimeter of the well 130. FIGS. 15 and 16 show vertical sectional views corresponding to FIGS. 5 and 6 but for the quarter round features 320 of FIG. 11.

Figure 12:
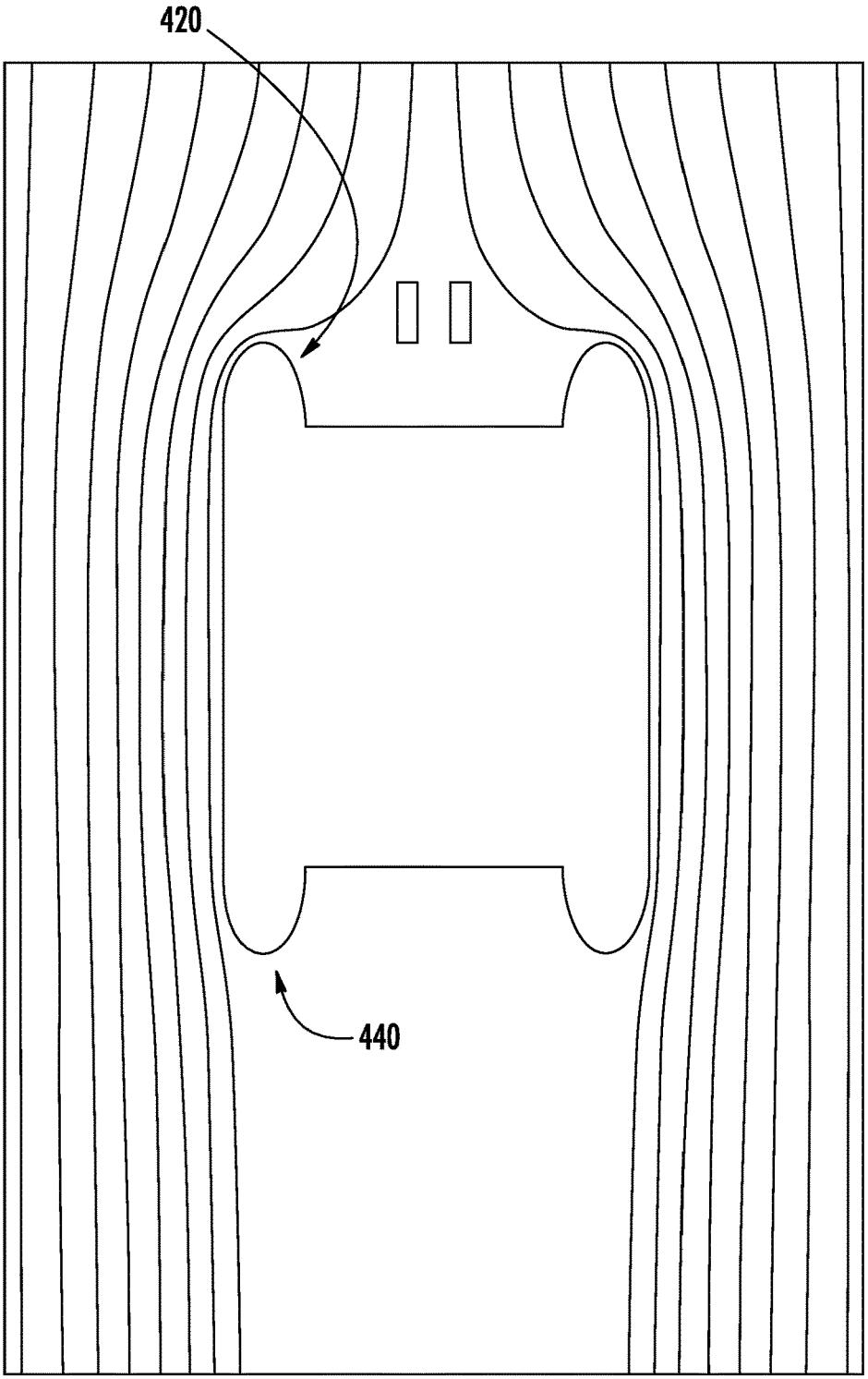
FIG. 12 is a schematic sectional view of a fifth modified car.

FIG. 12 is a schematic sectional view of a modified car having semi-elliptical features 420 and 440, respectively, top and bottom. The exemplary aspect ratio is 2:1 with the semi-major axis vertical. An alternative lower end for the aspect ratio is 1:2 or 2:3 or 1:1 or 3:2.

Figure 13:
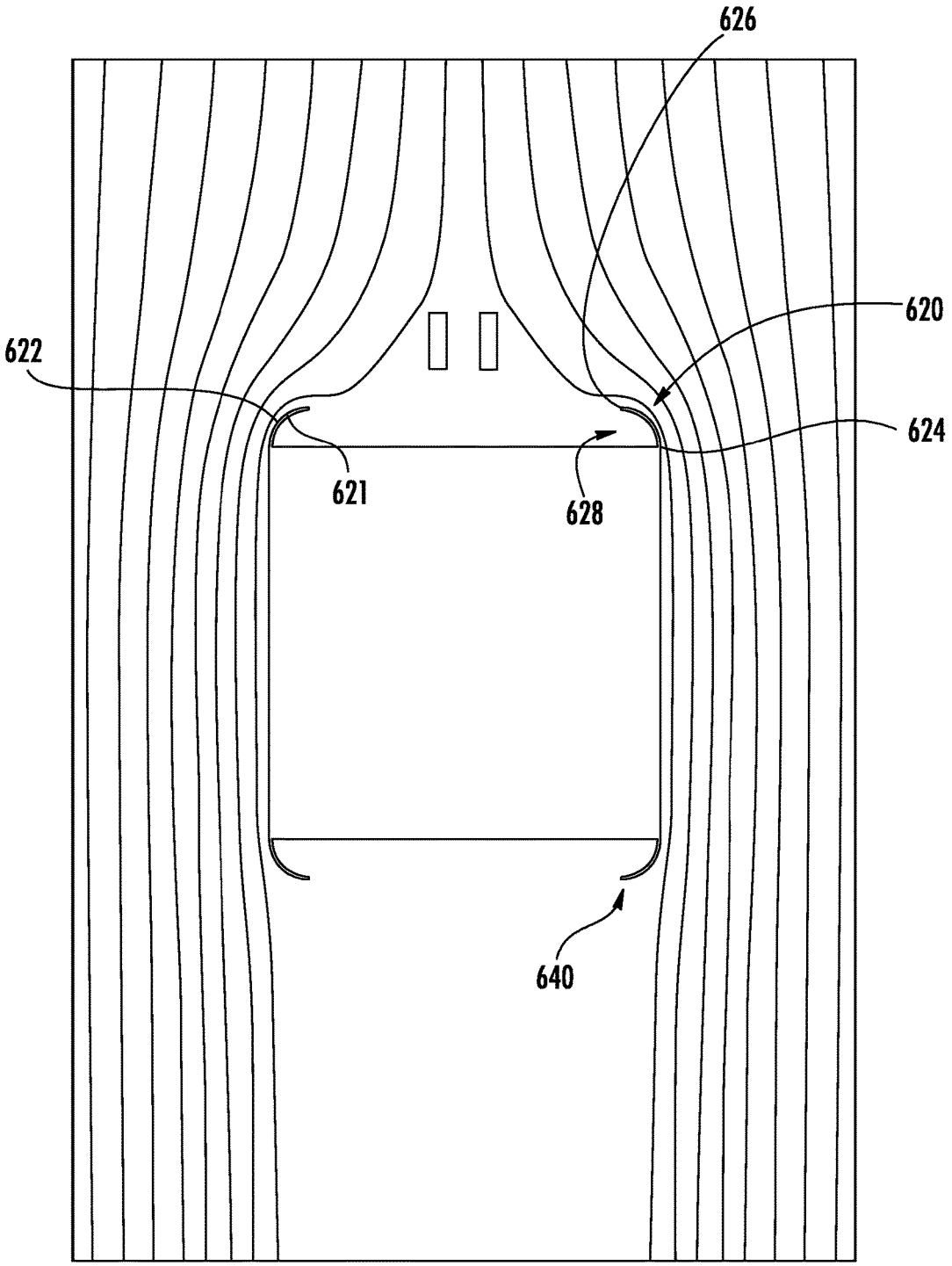
FIG. 13 is a schematic sectional view of a fifth modified car.

FIG. 13 is a schematic sectional view of a modified car having open quarter-round features 620 and 640, respectively, top and bottom. The features are open in that they lack the vertical surface 328 of FIG. 11 but are formed as a thin shell 621 having an outer convex surface 622 and extending from a lower end 624 to an apex 626 but having an opening 628 instead of the surface 328.

Figure 14:
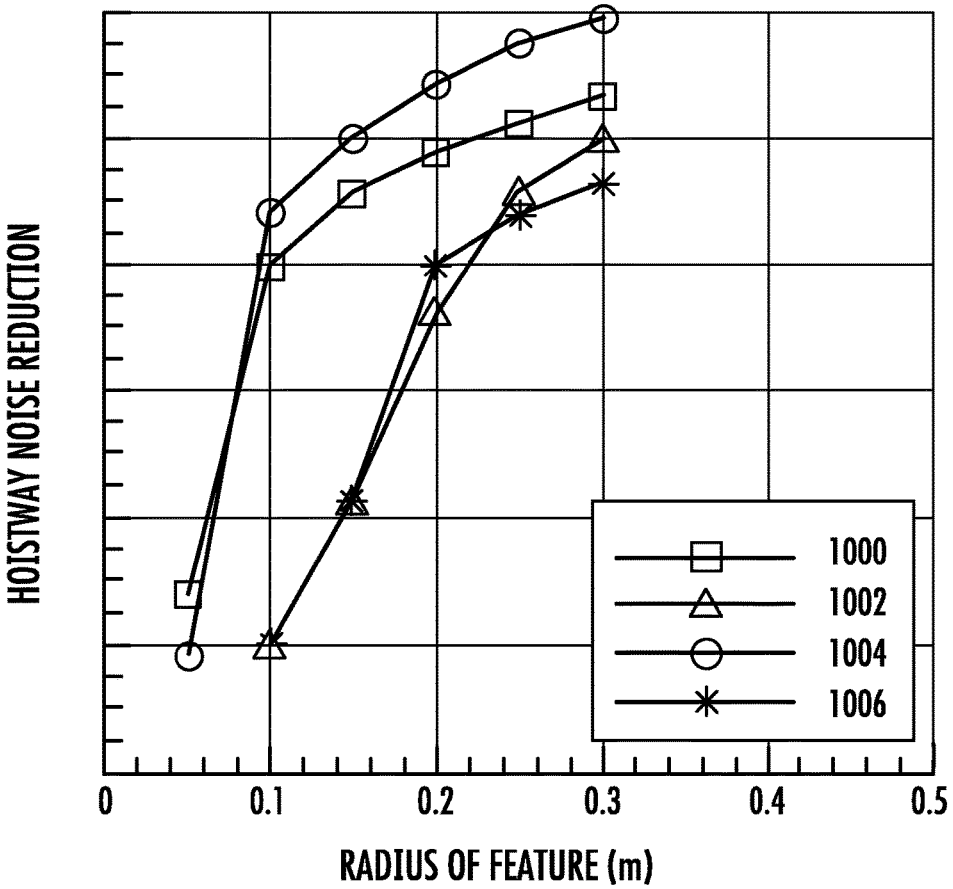
FIG. 14 is a plot of noise reductions for several of the modified cars.

FIG. 14 is a plot of noise reductions (during upward motion) for several of the modified cars against feature radius of curvature for cars having the aforementioned features top and bottom. The baseline is a FIG. 7 car of 1.9 m by 2.7 m footprint. Plot 1000 represents a FIG. 8 car. Plot 1002 represents a FIG. 11 car. Plot 1004 represents a FIG. 12 car (with 2:1 aspect ratio noted above and the semi-minor axis plotted instead of radius). Plot 1006 represents a FIG. 13 car. In these plots, the features are located along all four sides top and bottom. As noted above, toe guards may likely replace at least one of the four legs of the bottom feature.

Several things can be observed from FIG. 14. First, there is little difference between plots 1002 and 1006. This evidences that the surface 322, 622 is primarily responsible for performance between these two. Second, and in contrast, at a given radius of curvature, the plot 1000 clearly shows better performance than 1002. This indicates that having a convexity along at least a portion of the feature inboard of the apex is beneficial. Third, at a given feature width (and thus a given loss of available area of the upper surface 60 of the car top), there is a benefit seen in plot 1004 for the semi-elliptical feature rather than the semi-circular feature. Fourth, if one seeks a given available area of the upper surface 60, one must compare a given point on plot 1002 with points at half that radius on plots 1000 and 1004 (with noise reduction thus nearing equivalence). The FIG. 13 embodiment has more exposed upper surface area than in FIG. 11, but may be regarded as having the same useful area not obscured by the feature 620 being immediately above.

In any actual implementation, various features may be mixed and matched or otherwise varied in view of features of an actual elevator car to which they are being applied. One shroud feature on top need not be associated with a like feature of like scale on the bottom, but may be associated with no feature at all or some other feature. Other possible asymmetries include having differences between the features along the four edges of the car top or bottom.

A variety of materials and manufacturing techniques may be used to manufacture the shroud and assemble it to the elevator cab. For example, at a very basic level, essentially half-round or quarter round or third-round pieces may be cut from extruded plastic pipe stock. Mating ends may be cut at 45° angles. Clearly, efficient use of the pipes means that the cuts may cause a slight reduction in arc from the nominal value. At less than half-round, supports may be added at discrete locations or along the length of the piece of pipe (e.g., a right angle extrusion or vertical panel closing the vertical and optionally bottom of the quarter-round). Other possibilities may involve shaping plastic or metal sheet over arcuate supports (e.g., cut or molded blocks of the appropriate arcuate profile). Other such skin materials include cardboard or similar paper/fibrous material and fabrics. Securing to the cab top may be via adhesive, fasteners (e.g., screws, rivets, or removable snap fasteners) or a combination.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. An elevator car comprising:

a cab having a top, a bottom, a left side, a right side, a front, and a back, the front having a door, a vertical direction going from the bottom to the top;

a frame supporting the cab; and a fan, wherein;

the cab comprises a perimeter shroud protruding above a surface of the top and leaving a well exposing a central portion of an upper surface of the top;

the perimeter shroud protrudes above the upper surface;

the perimeter shroud has, when viewed in vertical section, a curved portion;

the fan is under the perimeter shroud aside the well; and the perimeter shroud covers the fan.

2. The elevator car of claim 1 wherein:
the perimeter shroud extends at least 250° around the perimeter of the top.

3. The elevator car of claim 1 wherein:
the perimeter shroud extends fully around the perimeter of the top.

4. The elevator car of claim 1 wherein:
the perimeter shroud leaves a door exposed.

5. The elevator car of claim 1 wherein:
the fan is positioned to drive an air flow through ports in the perimeter shroud.

6. The elevator car of claim 1 wherein:
the perimeter shroud encloses a fuse or circuit breaker box.

7. The elevator car of claim 1 wherein:
the perimeter shroud encloses electrical equipment.

8. The elevator car of claim 1 wherein:
the frame comprises: a crosshead (28), a pair of stiles (26,27), and a bolster (30).

9. The elevator car of claim 8 wherein:
the crosshead is spaced above the perimeter shroud by a gap of at least 0.5 m.

10. The elevator car of claim 1 wherein:
the perimeter shroud has a depth of 0.2 m to 0.5 m.

11. The elevator car of claim 1 wherein:
the perimeter shroud protrudes above the upper surface by 0.1 m to 0.4 m; and
the curved portion has a radius of curvature of 0.05 m to 0.60 m over an arc of at least 45°.

12. The elevator car of claim 1 wherein:
the curved portion has a radius of curvature of 0.15 to 0.30 m over an arc of at least 80°.

13. The elevator car of claim 12 wherein:
the curved portion has a said radius of curvature over a continuous said arc.

14. The elevator car of claim 1 further comprising:
a toe guard depending from the elevator along at least one side; and
a bottom perimeter shroud along at least two sides.

15. The elevator car of claim 1 wherein:
the perimeter shroud, in vertical section, is continuously curving over said arc.

16. The elevator car of claim 1 wherein:
said arc extends to within 0.05 m of an apex of the perimeter shroud.

17. The elevator car of claim 1 wherein:
said arc is formed along an extruded plastic member or along a bent sheet.

18. The elevator car of claim 1 wherein:
the curved portion is effective to provide at least one of a noise reduction or a drag reduction.

19. A method for retrofitting an elevator car to form the elevator car of claim 1, the method comprising:
installing the perimeter shroud.

20. An elevator car comprising:
a cab having a top, a bottom, a left side, a right side, a front, and a back, the front having a door, a vertical direction going from the bottom to the top;
a frame supporting the cab; and
electrical equipment atop the cab,
wherein;
the cab comprises a perimeter shroud protruding above a surface of the top and leaving a well exposing a central portion of an upper surface of the top;
the perimeter shroud protrudes above the upper surface;
the perimeter shroud has, when viewed in vertical section, a curved portion; and
the perimeter shroud encloses the electrical equipment aside the well below the curved portion.

* * * * *